United States Patent [19]

Torre

[11] 4,315,473

[45] Feb. 16, 1982

[54] MODULAR BENCH FOR SEWING MACHINE

[75] Inventor: Giancarlo D. Torre, Biassono, Italy

[73] Assignee: Rockwell-Rimoldi, S.p.A., Milan, Italy

[21] Appl. No.: 125,310

[22] Filed: Feb. 27, 1980

[30] Foreign Application Priority Data

Apr. 2, 1979 [IT] Italy ..... 21481 A/79

[51] Int. Cl.[3] ..... A47B 29/00

[52] U.S. Cl. ..... 112/217.1

[58] Field of Search ..... 112/217.1; 312/22, 23

[56] References Cited

U.S. PATENT DOCUMENTS

| | | | |
|---|---|---|---|
| 2,875,006 | 2/1959 | Hale | 112/217.1 |
| 3,168,880 | 2/1965 | Hofgesang et al. | 112/217.1 |
| 4,202,284 | 5/1980 | Parsons | 112/217.1 |

FOREIGN PATENT DOCUMENTS

| | | | |
|---|---|---|---|
| 1929022 | 12/1970 | Fed. Rep. of Germany | 112/217.1 |
| 2263328 | 10/1975 | France | 112/217.1 |

*Primary Examiner*—Ronald Feldbaum

[57] ABSTRACT

A modular bench for supporting a sewing machine in which the various elements comprising the support structure are formed from tubular material that can be joined by means of male and female connectors in a plurality of ways to support various sizes and shapes of working tables which are best suited for a particular sewing operation. Additionally, the bench is provided with noise and vibration dampening elements which are effective in elastically isolating the working table from the sewing machine and its operating motor and the latter two members from the support structure.

11 Claims, 13 Drawing Figures

MODULAR BENCH FOR SEWING MACHINE

BACKGROUND OF THE INVENTION

The present invention relates to a modular bench for supporting a sewing machine. Benches for sewing machines are well known in the art which provide a means for supporting the machine and its operating motor, as well as the pedal control unit therefore.

Depending on their particular design, the known forms of benches can be classified under two basic types with a first type being formed by a pair of lateral uprights which are commonly fabricated from cast iron of preformed sheet metal. These uprights are frequently adjustable for height and are interconnected by an upper and lower fixed cross member in which the upper one is located in a position that corresponds to approximately half the height of the uprights.

A table for supporting the sewing machine is fixed above the lateral uprights, and its operating motor is pivotably mounted on the upper cross-member, whilst the lower cross member is adapted to support a pedal control unit.

The second type of bench is known and referred to as a "column bench", and includes a supporting base portion with an upright that is commonly formed by two elements in which the lower one usually forms an integral part of the base portion. The upper element assembles in an adjustable manner in the lower element so as to provide a supporting column having a height which can be selectively varied. The upper end of the upright supports a single metal table on which the sewing machine and its operating motor are adapted to be mounted. Generally, a supplementary table is also required which is usually of the wooden type and serves solely for providing a supporting surface for a workpiece.

The known types of benches perform their intended function with a degree of satisfaction; however, they are considered to have a series of disadvantages which limit the possible ways which they can be utilized and do not provide working conditions that are considered advantages for a person operating a machine mounted thereon.

A significant disadvantage of these benches is that they are difficult to adapt to a variety of positions required by a sewing machine so as to accommodate workpieces that require different types of seaming operations. In fact, the known types of benches only provide a single position for locating a sewing machine and which according to their design cannot be altered. In practice, this has resulted in providing a bench which is designed for each specific sewing requirement. In order to satisfy the requirements of users, it has been necessary to make an excessively wide range of benches available which belong to one or the other of the two types described but include design differences in order to accommodate different positioning arrangements for the sewing machine.

Another disadvantage with benches of the known type is that they have no provision for modifying the arrangement of the bench and this is only accomplished by associating an additional bench, which substantially has the same design, therewith. This is necessary for example, when it is desired to provide the operator with additional work surface or with a larger workpiece supporting surface.

It can be readily understood that the necessity of additional benches can be quite costly and in many cases are not completely satisfactory for the positioning of one or more such benches in contiguous relation can easily result in forming a bench layout which is different from that actually desired.

A further disadvantage of these benches is that they have a structure which is considered extremely heavy and cumbersome, and in particular, the benches of the "column" type. It should also be understood that the benches of the first type described above also present problems resulting from their cumbersome nature and which are considered significant by those conversant in the art. Additionally, conventional benches lack a desirable feature of being easily moved from one location to another which can be attributed to the fact that their structure cannot be readily disassembled. At the most these benches may be sub-divided into a limited number of parts, for example, uprights and cross-pieces for the first type, and base parts and columns for the second type, but disassembled to this extent these individual parts are still extremely heavy and take up a considerable amount of space.

A still further disadvantage that is prevalent with conventional benches is that of considerable noise and the high level of vibration which develops when the sewing machine is operating. It is well known that sewing machines of the industrial type are run at a very high operating speed which creates a considerable amount of vibration both from the motor and from the machine itself. Due to the fact that the interconnecting elements between the sewing machine and motor and the bench are of the rigid type, it is quite obvious that the vibrations generated by the motor and the sewing machine will be transmitted to the bench. A condition of this nature is considered a serious disadvantage for when a large number of machines are operating in the same working area, it creates a very noisy environment and unpleasant conditions for the machine operators.

An object of the present invention is to provide a bench for supporting sewing machines which eliminates all of the disadvantages referred to above.

A particular characteristic of the bench according to the present invention is that it can be completely disassembled and reduced to a size whereby it takes up a minimum amount of space which facilitates transporting and storage thereof.

A further characteristic of the bench is that it is completely modular and can be assembled in accordance with a variety of different configurations each of which correspond to a specific requirement of the machine or to one particular type of seaming operation.

SUMMARY OF THE INVENTION

The bench for supporting a sewing machine according to the present invention includes a pair of spaced upright members which are interconnected by fixed cross-pieces, an operating motor for the machine and a pedal control unit for said motor. The upright members have a "C" shaped configuration with the upper branches thereof having a length which is less than that of the lower branches. Each of the upper branches of the upright members have a longitudinal support member assembled thereon with a mounting plate traversing the distance therebetween for supporting the sewing machine and a first vibration dampening means associated with the elements for mounting said longitudinal support members on said upper branches. A worktable is mounted on support brackets assembled on each end of the longitudinal support members and includes a second vibration dampening means interposed between said worktable and support brackets. The lower branches of the upright members are interconnected by cross-pieces which carry a support plate on which a pedal control unit is mounted in a selectively positionable manner.

Other characteristics and advantages of the bench according to the invention will become more fully apparent by reference to the appended claims and as the following detailed description proceeds in reference to the figures of drawing wherein:

DESCRIPTION OF THE PREFERRED EMBODIMENT

Figure 1A:
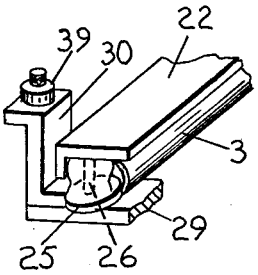
FIG. 1*a* shows the block and support ear assembly on an enlarged scale.
Figure 1:
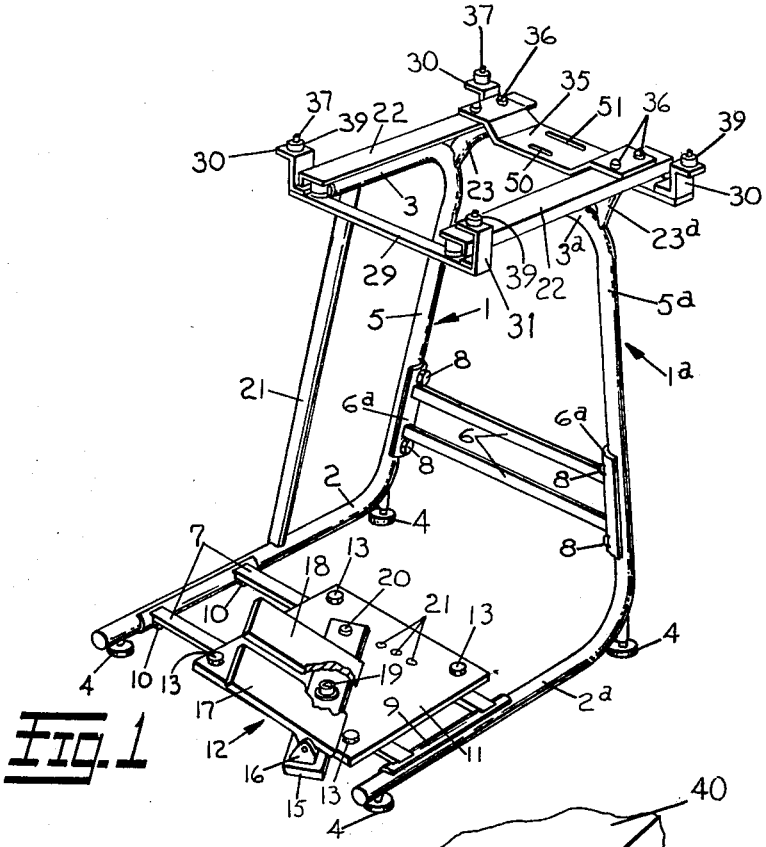
FIG. 1 is a perspective view showing the basic structure of the bench according to the invention.

Referring now to FIG. 1, the basic structure of the bench according to the invention is adapted to support the sewing machine, its operating motor and a pedal control unit, as well as other elements and connecting devices which because they are not needed for a full understanding of the invention, have not been shown.

The basic structure comprises a pair of spaced tubular upright members, generally indicated by numerals 1 and 1*a* and they have a configuration which is substantially that of the letter "C". The lower branches of these upright members form the base of the bench and are depicted by numerals 2 and 2*a* and the upper branches by numerals 3 and 3*a*. According to the preferred embodiment, the length of the upper branches 3 and 3*a* is approximately one half that of the lower branches 2 and 2*a*. Supporting feet 4 are attached to the ends of the lower branches 2 and 2*a* with at least one of said feet being of the height adjustable type.

Figure 2:
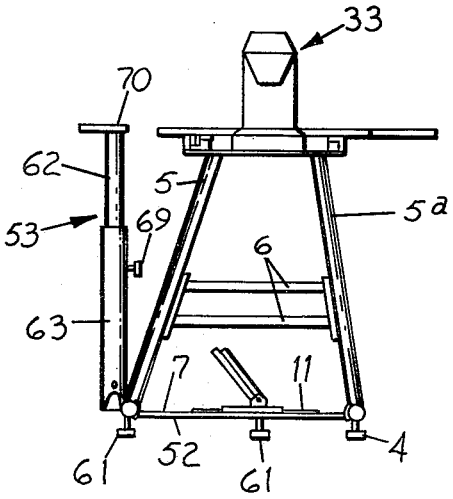
FIG. 2 is a view in front elevation showing further elements of the basic structure.

The tubular upright members 1 and 1*a* are disposed in spaced and opposed relation and their vertical sides 5 and 5*a* are inclined inwardly and upwardly as shown in FIG. 2.

The upright members 1 and 1*a* are interconnected by cross-members 6 and 7 and respectively they are disposed relatively close to the lower ends of the vertical sides 5 and 5*a* and the ends of the lower branches 2 and 2*a*.

Cross-member 6 is formed by two rod members of different lengths so as to accommodate the inclination of the vertical sides 5 and 5*a* and are interconnected at their ends by coupling elements 6*a* that are attached to said vertical sides by any suitable means such as screws 8.

The cross-member 7 has a structure which is substantially identical to that of cross-member 6; however, the two rod members are of equal length in view of the fact that the lower branches 2 and 2*a* are disposed in spaced and parallel relation. The cross-member 7 is also provided with coupling elements 9 fixed on the ends of the rod members and by means of screws 10 the combination of elements provides a rigid connection between the lower branches 2 and 2*a* of the upright members 1 and 1*a*.

A generally rectangular plate 11 is mounted for selective positioning on the cross-member 7 and provides a support means for a known type of pedal control unit 12 which can be positioned thereon in any one of a plurality of pre-determined locations.

Figure 8:
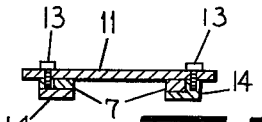
FIG. 8 is a sectional view as seen looking in the direction of the indicating arrows of line VII—VII in FIG. 3.

Referring again to FIG. 1 and to FIG. 8 which shows the plate 11 in cross section and the means by which it is assembled on the cross-member 7. The plate 11 is attached to the cross-member 7 by the combination of screws 13 and a pair of elongated L-shaped support members 14. As shown in FIG. 8 the horizontal portion of the support members 14 engage the underside of the cross-member 7 and the vertically extending portion is provided with tapped holes for receiving the threaded portion of screws 13 which pass through and beyond holes located adjacent each corner of the plate 11. To provide a stable positioning of plate 11 on the cross-member 7, the support members 14 have a length which is equal to that of the sides of plate 11.

From the above description it should be obvious that the position of plate 11 can be selectively located in accordance with a specific requirement of the operator. Actually, plate 11 can be displaced from the position shown in the various figures of drawings by being rotated through 90° or 180°. To rotate the plate 11 it is only necessary to remove the screws 13 to detach plate 11 from the cross member 7 and then reassemble it to the latter making sure that the support members 14 are in contiguous relation with the sides of plate 11 which are parallel to the cross member 7. With the pedal control unit 12 being fixedly attached to plate 11, its position will also change with the relocating of said plate 11.

A further characteristic of the bench according to the invention is that the pedal control unit 12 is carried by plate 11 in a selectively positionable manner. This can be best seen in FIG. 1 wherein the pedal control unit 12 which is of a known type includes a base 15 having a pair of spaced bosses 16 (one only shown) that provide a means for pivotably supporting a pair of control pedals 17 and 18.

The control pedals 17 and 18 are disposed adjacent to one of the ends of base 15 and by means of a pivot pin 19 (FIG. 1) said base is attached to the plate 11 in a manner whereby it can be selectively rotated as desired to place the control pedals in a position best suited for the operator.

The end of the base 15 opposite that with which the pedals are operatively associated is provided with a hole into which a positioning screw 20 assembles and with its threaded portion being receivable by any one of a plurality of threaded holes 21. The holes 21 are disposed in spaced relation along the arc of a circle having a radius which corresponds to the distance between the pivot pin 19 and screw 20. The combination of the holes 21 and screw 20 provide a means whereby the pedal control unit can be selectively pivoted to any one of a plurality of positions as desired. The bench according to the invention is provided on its left hand side as shown in FIG. 1, with a reinforcing upright element 21 that interconnects branches 2 and 3 of the upright member 1, and for this reason, the pedal control unit 12 is arranged so that it can only be directed either toward the forward side of the basic structure or toward the right hand side as shown in FIG. 1 which are the positions that are available to the operator.

Means for supporting the sewing machine and its operating motor are provided on the upper branches 3 and 3*a* of upright members 1 and 1*a* and define a pair of longitudinal members 22 which are substantially L-shaped and are supported at their ends in a manner yet to be described by the ends of branches 3 and 3*a* and extensions 23 and 23*a* of the upright members 1 and 1*a*. The extensions 23 and 23*a* are disposed so as to project in the opposite direction of branches 3 and 3*a* and in a manner whereby their longitudinal axes is substantially parallel to the axes of said branches so that the portion of said extensions 23 and 23*a* which support the longitudinal members 22 are horizontal.

Figure 7:
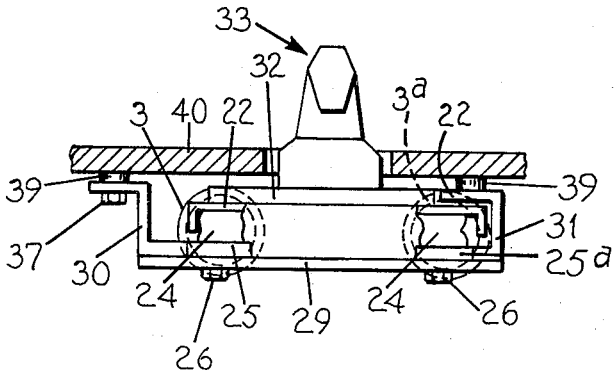
FIG. 7 is a view in front elevation on an enlarged scale, and partially in section of the upper portion of the basic structure.
Figure 1B:
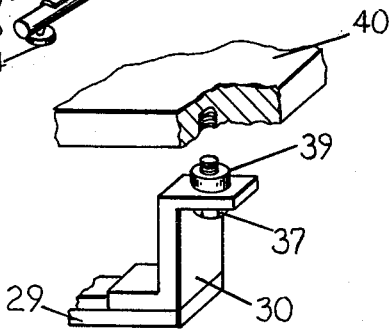
FIG. 1*b* shows the S-shaped support brackets on an enlarged scale.

With reference now to FIG. 7, the longitudinal members 22 are supported by branches 3 and 3*a* of the upright members 1 and 1*a* with the interposition of a first vibration dampening means that defines substantially cylindrical rubber blocks 24.

In particular, the rubber blocks 24 are supported by means of identical ears 25 and 25*a* which project longitudinally from the ends of branches 3 and 3*a* respectively. One of these ears which as shown in greater detail in the part of FIG. 1 shown on an enlarged scale, is provided with a central hole through which a cap screw 26 extends and maintains the longitudinal member 22 in contact with the block 24 by means of the threaded portion of said cap screw being assembled in an aligned tapped hole (not shown) provided in said longitudinal member. A cross-member 29 is located below and in contact with the underside of the ears 25 and 25*a* and is fixed in this position by means of the cap screw 26. The length of cross-member 29 is greater than the distance between the rubber blocks 24 so that its ends protrude beyond the outer sides of the ears 25 and 25*a*.

The means for supporting the longitudinal members 22 by the extensions 23 and 23*a* is identical to the elements described which are operatively associated with branches 3 and 3*a* of the upright members 1 and 1*a* and a detailed description of this means is considered unnecessary.

The upper surface of the protruding ends of the forward and rear cross-members 29 have support brackets 30 and 31 fixed thereon by any suitable means such as by welding.

The support brackets 30 have a configuration that is substantially S-shaped with their upper and lower surfaces being disposed in parallel relation and substantially horizontal. The support brackets 30 are disposed in correspondence with three of the vertices of a quadrilateral formed by the combination of the longitudinal members 22 and cross-members 29, and in particular, they are disposed in correspondence to the vertices of the sides opposing those in front of which the operator is seated during operation of the sewing machine.

Bracket 31 on the other hand has a configuration that is substantially "C" shaped with its upper and lower surfaces being parallel and substantially horizontal and which is attached to its respective cross-member 29 in the same manner as support brackets 30.

The longitudinal members 22 define a supporting frame on which a plate 32 is fixed that serves to support a known type of sewing machine generally indicated by numeral 33 which has been shown diagrammatically in various figures of the drawings. To fixedly attach the plate 32 to the longitudinal members 22, the latter, as is well known, are provided with a series of holes and elongated openings (not shown) for selectively positioning supporting plates to accommodate sewing machines of different sizes. The longitudinal members 22 are interconnected at a location corresponding to the area at which they are fixed to the extensions 23 and 23*a* by means of a bracket 35 which is adapted to support the operating motor for the sewing machine. The bracket 35 defines a substantially rectangular plate having a central planar surface which is formed so as to be disposed at a level which is lower than that of the ends of the bracket. These ends are provided with holes through which cap screws 36 extend and their threaded portions can either assemble in tapped holes provided in the longitudinal members 22 or extend through the latter and have locking nuts assembled on said threaded portions. A working table 40 is fixed to the upper horizontal surface of the support brackets 30 and 31 by means of screws 37 which extend through appropriate openings in said brackets and with their threaded portions assembled in tapped holes provided on the underside of said working table. A second vibration damping means which is in the form of a rubber washer 39 assembles on each screw 37 in a manner so as to be interposed between the underside of the working table 40 and the upper surface of the support brackets 30 and 31.

From the foregoing it should be obvious that the combination of rubber blocks 24 and rubber washers 39 provide a means of dampening operating vibrations whereby the transmission of such to the working table 40 is practically eliminated.

Figure 10:
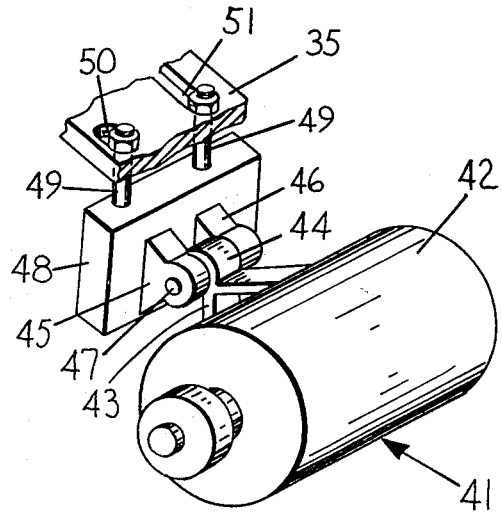
FIG. 10 is a perspective view showing the machine's operating motor and the means by which it is attached to the bench.

Referring now to FIG. 10, the operating motor for the sewing machine which is supported on the bench comprising the invention is diagramatically shown and identified generally by numeral 41. This motor 41 is of a well known electric type having a stator 42 and a projection 43 which extends in a radial direction from said stator. This projection 43 is of a triangular configuration and with the vertex 44 thereof being substantially cylindrical. The vertex 44 of projection 43 is provided with a transverse hole for receiving a locking pin 47. The end 44 of projection 43 is positioned between two supporting brackets 45 and 46 which are both provided with a transverse hole. The projection 43 can be fixedly positioned by means of the locking pin 47 to the brackets 45 and 46 and its position as well as that of the motor 41 can be selectively changed. The brackets 45 and 46 form an integral part of a support plate 48 which is provided with two supporting pins 49 having threaded ends that provide a means for its attachment to bracket 35. As shown in FIGS. 1 and 10 bracket 35 includes two elongated openings 50 and 51 of different lengths through which the threaded ends of the support pins 49 are adapted to extend and as shown in FIG. 10, lock nuts are assembled on the threaded portions of said support pins 49 which protrude through the elongated openings 50 and 51 and provide the means for fixedly attaching the support plate 48 to the bracket 35.

It should be obvious from the foregoing that the position of the operating motor 41 can be modified both in height as well as transversely, and the position of projection 43 with respect to the support plate 48 can be modified and the supporting pins 49 can be fixed at any desired location within the limits of the elongated holes 50 and 51 on the bracket 35. The possible positions between the sewing machine 33 and the motor 41 is provided for by the elongated holes 50 and 51 in bracket 35 and by elongated and circular holes, which are not shown, in the plate 32 which makes it possible to selectively locate the motor in its most desirable operating position. The bench according to the invention includes means that make it possible to use further supporting means for a workpiece, i.e. additional work tables which utilize the basic structure described above. This is made possible in view of the fact that the bench includes a first extending element 52 which can be attached to the lower branches 2 and **2*a* of upright members 1 and 1*a* and is adapted to carry a supporting upright 53** the upper end of which supports an additional work table and which is selectively adjustable relative to its height.

Figure 9:
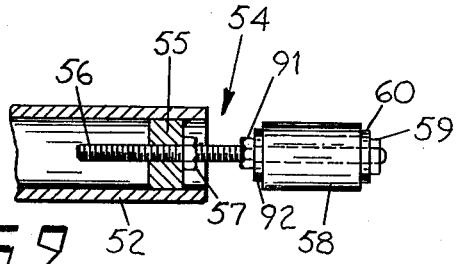
FIG. 9 is an elevational view partially in section showing the means for interconnecting one structural element to another.
Figure 3:
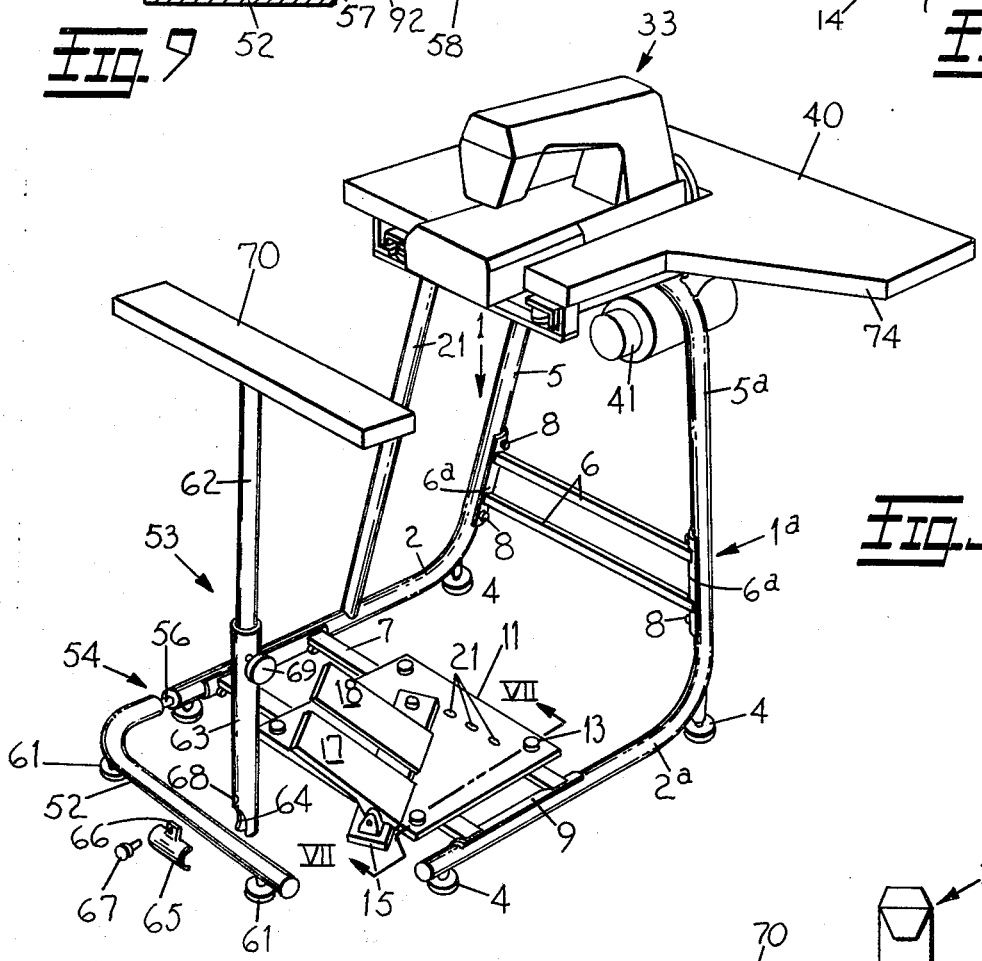
FIG. 3 is a perspective view of one form the bench may take utilizing the basic structure shown in FIG. 1.

With reference to FIG. 3 wherein the same parts shown in FIG. 1 are identified with the same reference numerals, the extending element 52 defines a tubular member having an end that is folded in the form of an elbow and which is adapted to assemble to the forward end of branch 2 of the upright member 1. Assembly of the extending element 52 to the upright member 1 is accomplished by means of a male connector provided on one end of said extending element and which is identified generally in FIG. 9 by numeral 54. This male connector 54 is adapted to assemble within a female end formed at the lower end of the upright member 1. The extending element 52, as shown in FIG. 9, includes a disc 55, which is fixed within and adjacent the end of said extending element 52 by any suitable means such as welding. Disc 55 is provided with a threaded hole which supports a threaded rod 56 that protrudes outwardly beyond the end of the extending element 52 and is fixed in the disc by means of a locknut 57. That portion of the threaded rod 56 which protrudes from the extending element 52 has a sleeve 58 fabricated from a suitable elastomeric material assembled thereon and is held in position by means of a nut 59 and a washer 60 in contact with one end of said sleeve and a nut 61 and a washer 62 in contact with the opposite end. In FIG. 9 the sleeve 58 is shown in its free or rest position, i.e. it has not been subjected to compression. To connect the extending element 52 to the branch 2 of the upright member 1, the male connector 54 is inserted into the end of branch 2 which defines a female connector leaving a slight amount of clearance between the end of the latter and the end of the extending element 52. The nut 61 is then turned so as to move toward the sleeve 58 to effect compression and consequent expansion of sleeve 58 which being disposed internally of the female end of branch 2, becomes locked to the internal surface thereof. This procedure fixes the extending element 52 to the basic structure and is provided in order to form a part of the base of the bench with feet 61 and with at least one of the latter being adjustable relative to its height. The opposite end of extending element 52 is hollow like the female end of the branch 2. The upright 53 is formed by two tubular members 62 and 63 in which member 62 being the upper one is slidably assembled within member 63. The lower tubular member 63 is provided at its lower end with a notch 64 which conforms to the radius of the extending element 52 and by means of a cap 65 having a configuration conforming to the radius of said notch, a means is provided, now to be described, for attaching said lower tubular member to said extending element.

This cap 65 includes an upwardly directed appendix 66 having a hole for receiving a screw 67, the threaded portion of which assembles in a hole 68 provided in the lower tubular member 63. This means of attaching the upright 53 permits it to be selectively located in any desired position along the entire length of the extending element 52.

Figure 5:
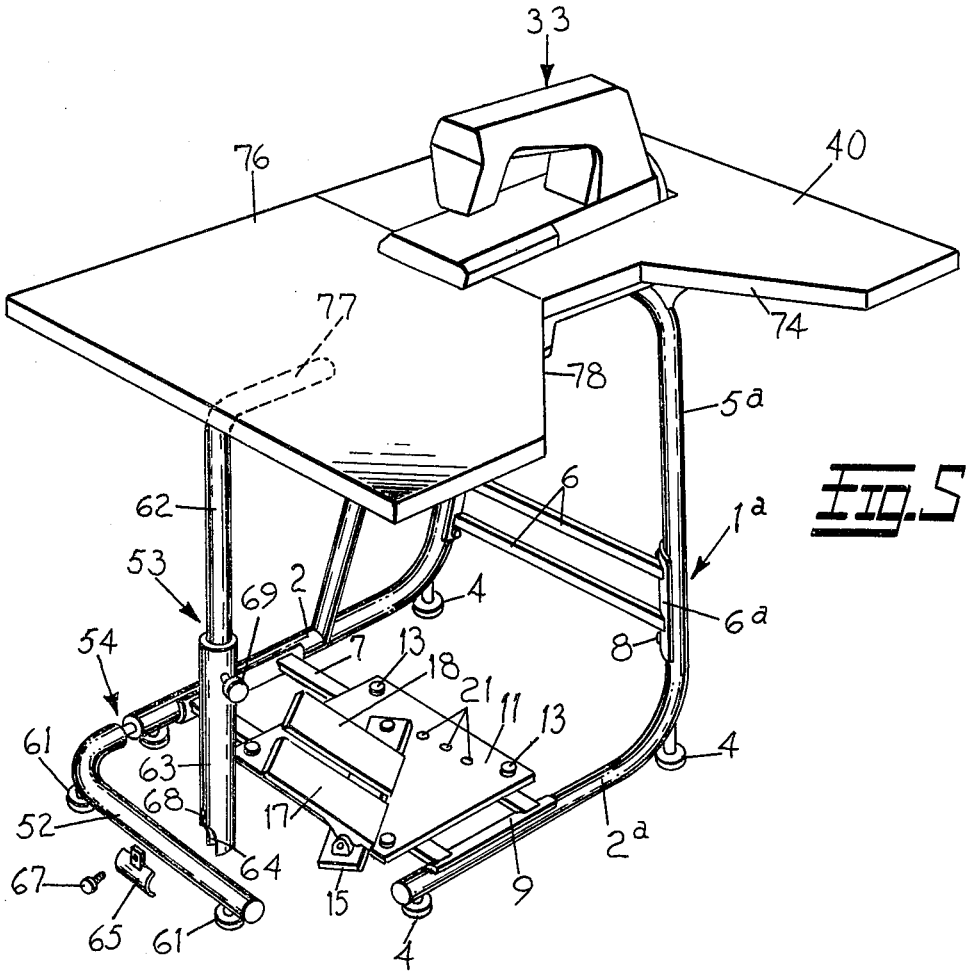
FIG. 5 is a perspective view similar to FIG. 4 but showing more structural elements for producing yet another form of bench.

Further modification of the bench according to the invention is shown in FIG. 5, which differs from the previous ones by means of a work table 76 which is supported so that one edge thereof is disposed in contiguous relation with one edge of the table 40.

Work table 76 is also supported by the upright 53 by being fixedly attached to the upper end of the tubular member 62 which being identified by numeral 77 in FIG. 5 has been formed so as to extend at a right angle to the lower portion thereof. Like work table 71, work table 76 is provided with an angularly extending edge 78 and in combination with edge 74 of table 40, a recessed area is provided which also serves to provide access to the sewing machine by the operator.

Figure 4:
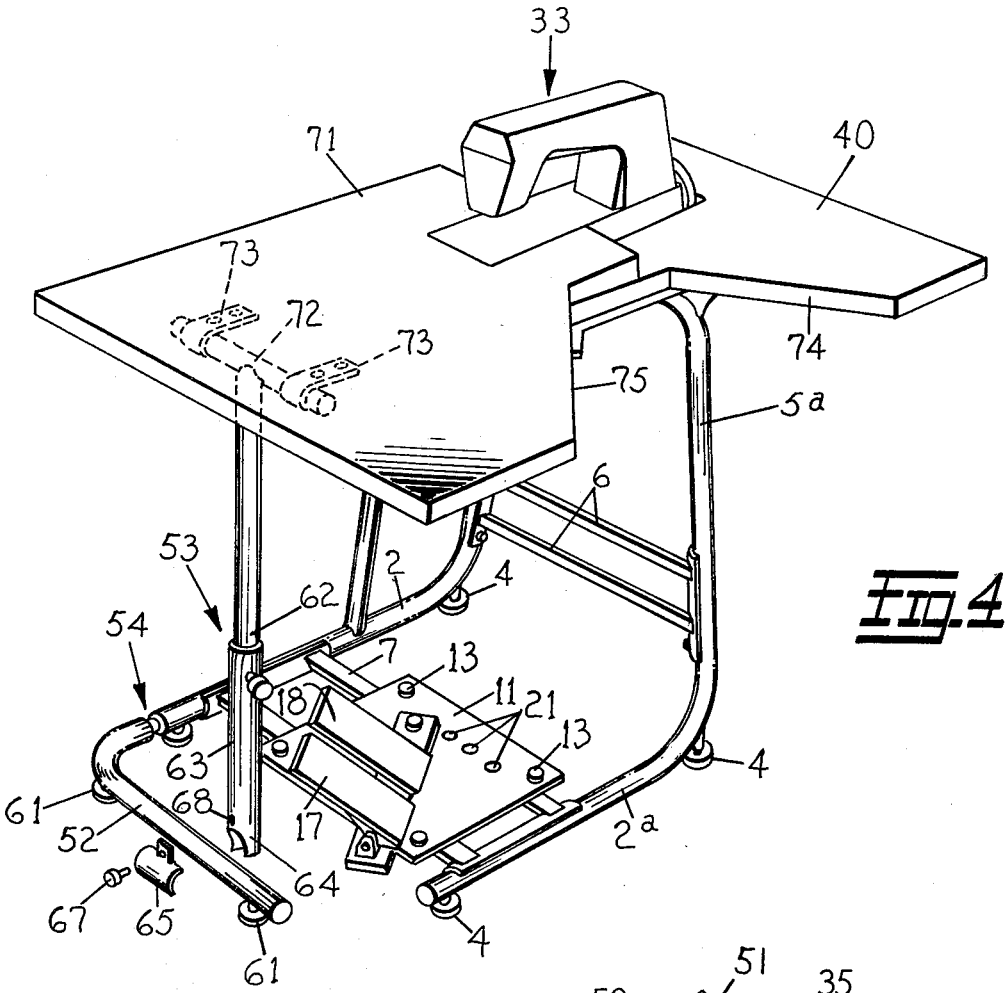
FIG. 4 is a perspective view similar to FIG. 3 but showing additional structural elements for producing another form of bench.

It should be understood that work table 76 could also be supported on the upright 53 by a hinging arrangement like that shown in FIG. 4 and would permit said worktable 76 to be pivoted from its working position for the same reasons described above for work table 71.

Figure 6:
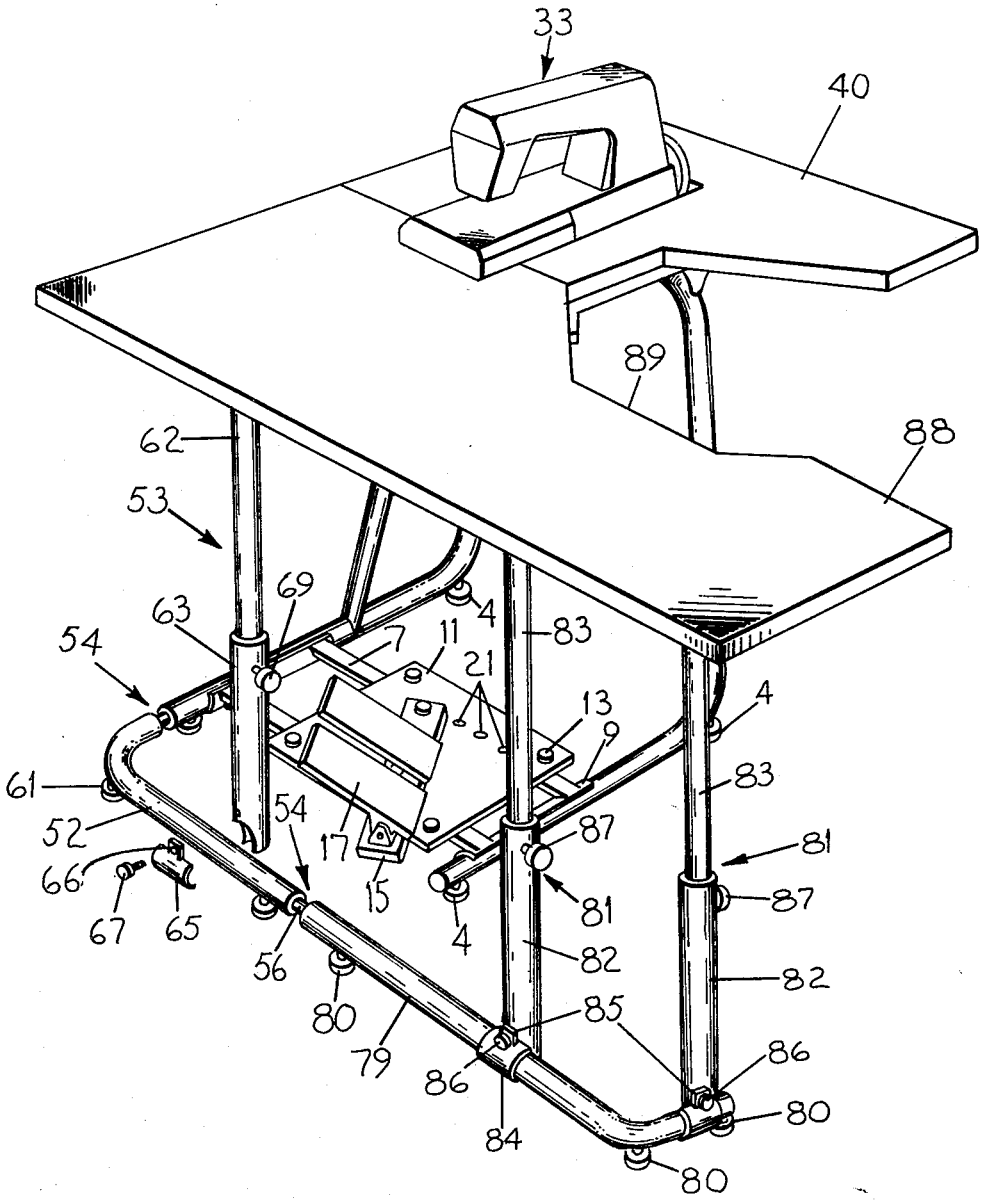
FIG. 6 is a perspective view similar to FIGS. 3–5 showing a further arrangement of a bench by incorporating a greater number of structural elements.

With reference now to FIG. 6, a further modification of the bench according to the invention is shown in which a supplementary working table 88 associated with table 40 extends over a substantially greater area than the work tables 70, 71 and 76 described above. In this figure of drawing it will be noted that this modification of the invention utilizes the same basic structure heretofore described as well as the extending element 52 and the upright 53. The bench shown in FIG. 6 is provided with an additional extending element 79 which is also of tubular configuration and is adapted to be attached to the extending element 52 in the same manner as the latter is attached to the end of branch 2 of tubular upright member 1. Although it is not shown in detail, the end of the extending element 79 which attaches to extending element 52 has a male connector which is identical to that shown in FIG. 9. The end of the extending element 79 opposite to the end having the male connector defines the female end of said element. Like the extending element 52, extending element 79 is provided with a plurality of supporting feet that are depicted by numeral 80 and with at least one thereof being of the adjustable type for obvious reasons.

As shown in FIG. 6, two uprights generally indicated by numeral 81 are attached to the extending element 79, and they have a structure as well as a means for attachment to said extending element 79 which is identical to that described for the upright 53. The lower and upper tubular members of uprights 81 are identified by numerals 82 and 83 respectively and the lower ones are each provided with a notch (not shown) like the one depicted by numeral 64 for upright 53 which serve to position them for attachment to the extending element 79.

The means of connecting the uprights 81 to the extending element 79 is identical to the cap 65 and screw 67 arrangement utilized for the upright 53. The caps for uprights 81 are identified by numeral 84 and include an upwardly directed appendix 85 having a hole for receiving a screw 86 in which the threaded portion thereof assembles in a hole not shown provided in the lower tubular members 82. Like the upper tubular member 62 of the upright 53, the upper tubular members 83 can be selectively positioned at any desired height by means of a locking screw 87 carried by each of the lower tubular members 82.

The work table supported by the combination of uprights 53 and 81 is depicted by numeral 88 (FIG. 6) and being substantially larger than work tables 70, 71 and 76, it, like work table 76 has one edge thereof disposed in contiguous relation with one side of work table 40. This work table 88 extends rearwardly of the operator's working position and is especially adapted for workpieces of considerable length. The work table 88 also includes a recessed portion 89 and like the work tables shown in FIGS. 4 and 5, it provides a location where the operator is seated while operating the sewing machine.

The means by which the work table 88 is supported by uprights 53 and 81 is not shown for the same elements shown in FIGS. 4 and 5 for supporting work tables 71 and 76 respectively, can be utilized.

Figure 11:
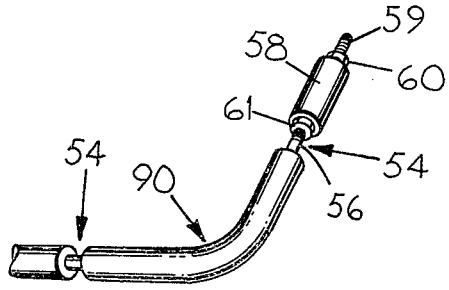
FIG. 11 is a perspective view of a structural connecting element.

Referring now to FIG. 11, a tubular connecting element generally indicated by numeral 90 is shown which has a configuration that is generally "L" shaped and is of a length which is limited with respect to extending elements 52 and 79. A male connector 54 is provided on each end of the tubular connecting element 90 so as to be applied to any one of the female ends of the tubular shaped members of the bench.

The function of connecting element 90 is to provide for extension of the bench in a direction opposite those described above which are directed generally toward the operator. The extending elements 52 and 79 are not adapted to effect extension of the bench toward the rear of the machine as they can only be attached to the basic structure in the manner shown in the various figures of drawings.

On the other hand, when connecting element 90 is attached, for example to the end of branch 2 of the upright member 1, it is then possible to attach the extending element 52 or the extending element 79 so that it will be directed towards the rear portion of the sewing machine and in the direction of advance of a workpiece. This embodiment is not specifically shown since it is considered to be an obvious combination in view of the manner in which the various elements are caused to be interconnected. It should be obvious that the various extension and connecting elements could be combined in a number of different ways which would produce a number of different bench layouts that could be developed to accommodate a variety of different sewing conditions. There are many advantages provided by the bench according to the present invention and in particular the fact that the length of the upper branches 3 and **3*a* of the upright members 1 and 1*a* are substantially half that of the lower branches 2 and 2*a* in combination with the fact that the sewing machine 33 is mounted with its forward part substantially in line with the ends of the upper branches provides a structure which is particularly stable. In practice, the sewing machine 33 is located above the central region of the perimeter of the base of the bench, i.e. above the central region of the rectangle which is formed by joining the vertices of branches 2 and 2*a* of the upright members 1 and 1*a*. This stability of the bench structure is mainly due to the fact that the center of gravity of the sewing machine 33** is located in a region whereby the vertical projection thereof is situated at the center of the base surface of the bench.

From the detailed description it can be seen that a further advantage of the invention is that the sewing machine is readily assesible by the operator either from the side or the front thereof and the pedal control unit can be selectively positioned for its intended function in any desired location.

Another advantage of the invention is the substantial reduction in noise and vibration that is common with conventional sewing machine benches and can be attributed to the fact that the sewing machine, its operating motor and the supporting means for each define a single structure which is supported by means of vibration dampening elements on the upright members 1 and **1*a*. Vibrations which are transmitted to the working table 40 are eliminated. By means of rubber washers 39 being interposed between said working table and the bench and because the table is insulated by means of rubber blocks 24 from the means for supporting the sewing machine and its operating motor. This arrangement of the dampening elements provide a complete elastic isolation of the sewing machine, its operating motor and the working table 40**.

The elimination of vibration makes it possible to assemble the bench to any desired form as heretofore described for there is no danger of transmitting or amplifying vibrations and it also permits utilization of conventional tubular stock for the parts which form the base and the upright members.

A further advantage of the bench according to the present invention is that it can be completely disassembled and the space which it occupies can be reduced to a minimum. This advantage facilitates transportation of the bench and makes it possible to provide a considerable range of combinations thereof with each adapted for a particular working requirement.

With the bench being completely modular and the fact that the various components thereof can be asembled in a number of different ways, it is possible to provide a bench having a configuration best suited for a particular sewing requirement.

A still further advantage of the bench according to the invention is that it combines the characteristics of conventional benches whether they be of the type having sheet metal uprights or of the column type.

In practice, the bench according to the invention takes up extremely reduced space in the traverse sense and is attributed to the fact that the upright members are convergent.

Although the present invention has been described in connection with a preferred embodiment and certain modifications thereof, it is to be understood that other modifications and variations may be resorted to without departing from the spirit and scope of the invention as those skilled in the art will readily understand. Such modifications and variations are considered to be within the purview and scope of the invention and the appended claims.

I claim:

1. A modular bench for supporting a sewing machine, its operating motor and a pedal control unit for effecting selective actuation of the operating motor, said modular bench comprising:

(a) a pair of spaced upright members (1, 1*a*) including:
  (i) lower branches (2, 2*a*) defining a base; and
  (ii) upper branches (3, 3*a*) extending parallel with and having a length less than said lower branches;

(b) cross pieces (6, 7) interconnecting said spaced uprigths (1, 1*a*);

(c) a longitudinal member (22) mounted on each said upper branches (3, 3*a*);

(d) a plate 32 fixed to and interconnecting said longitudinal members (22) for supporting the sewing machine;

(e) a bracket 35 fixed to and interconnecting said longitudinal members 22 for supporting the machine's operating motor;

(f) a first vibration dampening means operatively connected to said upper branches (3, 3*a*) for elastically isolating said plate 32 and bracket 35 from said upright members (1, 1*a*);

(g) support brackets (30, 31) attached to said vibration dampening means for supporting a working table (40) in operative association with the sewing machine;

(h) a second vibration dampening means interposed between said support brackets (30, 31) and working table (40) for elastically isolating the latter from the sewing machine and operating motor;

(i) a plate (11) mounted on said cross piece (7) for supporting the pedal control unit; and (j) means for selectively locating the pedal control unit in any one of a plurality of predetermined positions on said plate 11.

2. The structure according to claim 1 wherein said upright members (1, 1*a*) are fabricated from tubular material with the length of said upper branches (3, 3*a*) being substantially equal to half the length of the lower branches for positioning the sewing machine above the central portion of the perimeter of the base.

3. The structure according to claim 1 wherein said first vibration dampening means define cylindrical rubber blocks (24).

4. The structure according to claim 1 wherein said second vibration dampening means define rubber washers (39).

5. The structure according to claim 1 wherein the ends of said lower branches (2, 2*a*) define female connectors.

6. The structure according to claim 5 wherein said modular bench includes at least one extending element (52, 79) fabricated from tubular material with one end defining a female connector and the opposite end having a male connector (54) assembled therein for attaching said extending element to one of the female connectors forming the ends of said lower branches (2, 2*a*).

7. The structure according to claim 6 wherein said extending element (52, 79) includes at least one supporting upright (53, 81) connecting it with the working table (70, 71, 76, 88).

8. The structure according to claim 1 wherein the pedal control unit is mounted for selective rotatable movement on said plate (11).

9. The structure according to claim 8 wherein said means for selectively locating the pedal control unit defines a plurality of threaded holes (21) disposed in spaced relation along the arc of a circle in said plate 11 for selectively receiving a screw (20) carried by the pedal control unit.

10. The structure according to claim 1 wherein said modular bench includes an L-shaped connecting element (90) formed from tubular material with both ends thereof having a male connector (54) assembled therein.

11. The structure according to claim 1 wherein said crosspiece (6) has a configuration for effecting a greater distance between the lower branches (2, 22) relative to said upper branches (3, 3*a*).

* * * * *